US009091512B2

(12) United States Patent
de Haas et al.

(10) Patent No.: US 9,091,512 B2
(45) Date of Patent: Jul. 28, 2015

(54) BALLISTIC RESISTANT ARTICLE COMPRISING A SELF-CROSSLINKING ACRYLIC RESIN AND/OR A CROSSLINKABLE ACRYLIC RESIN AND PROCESS TO MANUFACTURE SAID ARTICLE

(75) Inventors: Marc-Jan de Haas, Apeldoorn (NL); Alex van Norel, Duiven (NL); Vincent van Bommel, Zevenaar (NL); Ramon van Rooij, Huissen (NL); Nicolas Cunningham, Brampton (CA); Chinkalben Patel, Ancaster (CA)

(73) Assignees: Teijin Aramid B.V. (NL); Barrday, Inc. (CA)

( * ) Notice: Subject to any disclaimer, the term of this patent is extended or adjusted under 35 U.S.C. 154(b) by 0 days.

(21) Appl. No.: 13/979,667

(22) PCT Filed: Jan. 18, 2012

(86) PCT No.: PCT/EP2012/050705

§ 371 (c)(1),
(2), (4) Date: Jul. 15, 2013

(87) PCT Pub. No.: WO2012/098158

PCT Pub. Date: Jul. 26, 2012

(65) Prior Publication Data

US 2013/0284007 A1 Oct. 31, 2013

Related U.S. Application Data

(60) Provisional application No. 61/433,772, filed on Jan. 18, 2011.

(30) Foreign Application Priority Data

Jan. 18, 2011 (EP) ..... 11151240

(51) Int. Cl.
*F41H 5/04* (2006.01)

(52) U.S. Cl.
CPC ..... *F41H 5/0485* (2013.01); *F41H 5/0435* (2013.01); *F41H 5/0464* (2013.01); *F41H 5/0478* (2013.01); *Y10T 156/10* (2015.01)

(58) Field of Classification Search
CPC ... F41H 5/0478; F41H 5/0485; F41H 5/0435; F41H 5/0464
USPC ..... 89/36.02, 915
See application file for complete search history.

(56) References Cited

U.S. PATENT DOCUMENTS

| | | | | |
|---|---|---|---|---|
| 4,683,172 | A | 7/1987 | LeGrand et al. | |
| 5,753,362 | A * | 5/1998 | Kawase et al. | 428/327 |
| 6,893,704 | B1 | 5/2005 | van der Loo | |
| 2006/0135022 | A1 * | 6/2006 | Porter | 442/381 |
| 2011/0203449 | A1 * | 8/2011 | Ardiff et al. | 89/36.02 |

FOREIGN PATENT DOCUMENTS

| | | |
|---|---|---|
| EP | 0169432 | 1/1986 |
| WO | 9108895 | 6/1991 |
| WO | 2004074761 | 9/2004 |
| WO | 2006049651 | 5/2006 |

OTHER PUBLICATIONS

Dupont, Advanced Fibers Systems: "Kevlar Aramid Fiber," Technical Guide. Retrieved from http://www2.dupont.com/Kevlar/en_US/assets/downloads/KEVLAR_Technical_Guide.pdf on Jul. 11, 2013.

International Search Report for PCT Application PCT/EP2012/050705 completed Apr. 20, 2012.

* cited by examiner

*Primary Examiner* — Stephen M Johnson
(74) *Attorney, Agent, or Firm* — Carlson, Gaskey & Olds, P.C.

(57) ABSTRACT

A ballistic resistant article is presented comprising a plurality of fibrous layers, each of said layers comprising a network of fibers, wherein the fibers have a strength of at least 800 mN/tex (1100 MPa) according to ASTM D 7269-07 and a matrix material, wherein the matrix material comprises a mixture comprising at least one self-crosslinking acrylic resin and/or at least one crosslinkable acrylic resin, and at least one tackifier. Compared with an article of the same construction but with a matrix material without tackifier the article according to the invention comprises a higher adhesion between the fibrous layers both in the unaged and aged state and a lower water pick up after water soak and the article passes the gasoline soak test. The article additionally comprising a plate of metal or ceramic exhibits minimal or even no delamination of the fibrous layers after ballistic attack, whereas an article of the same construction but with a matrix material without tackifier exhibits interior delamination of the fibrous layers.

14 Claims, No Drawings

BALLISTIC RESISTANT ARTICLE COMPRISING A SELF-CROSSLINKING ACRYLIC RESIN AND/OR A CROSSLINKABLE ACRYLIC RESIN AND PROCESS TO MANUFACTURE SAID ARTICLE

This application is a 371 of PCT/EP 2012/050705, filed on Jan. 18, 2012; which claims priority from application Ser. No. 61/433,722, filed on Jan. 18, 2011.

BACKGROUND

The present invention pertains to a ballistic resistant article and to a process to manufacture said article.

WO 2008/077605 describes a ballistic resistant sheet comprising a stack of at least 4 monolayers, each monolayer containing unidirectionally oriented reinforcing fibers with a tensile strength of between 3.5 and 4.6 GPa, the fiber direction in each monolayer being rotated with respect to the fiber direction in an adjacent monolayer, an areal density of a monolayer of at least 25 g/m$^2$ and at most 20 mass % of a matrix material preferably selected from the group of polyurethanes, polyvinyls, polyacrylics, polyolefines, polyisoprene-polyethylene-butylene-polystyrene block copolymers or polystryrene-polyisoprene-polystyrene block copolymers. The latter block copolymer is used in the example of WO 2008/077605 and therefore, especially preferred.

However, there is a demand for ballistic resistant sheets with a higher adhesion between the monolayers not only in the unaged state of the ballistic resistant sheet but also after aging the sheet in a climate at elevated values of temperature and relative humidity and/or in a chemically degrading atmosphere, e.g. in an oxygen atmosphere.

Furthermore, there is a demand for ballistic resistant sheets with a lower water pick up after water soak. And there is a demand for ballistic resistant sheets which pass the gasoline soak test.

Finally, if the ballistic sheet is joined to a plate of metal or ceramic, there is a demand for a higher structural integrity of the monolayers behind the plate after a ballistic attack from the plate side. So, there is a demand for a lower degree of delamination between the monolayers behind the plate after a ballistic attack.

SUMMARY

Said problems are solved by a ballistic resistant article comprising a plurality of fibrous layers, each of said layers comprising a network of fibers, wherein the fibers have a strength of at least 800 mN/tex (1100 MPa) according to ASTM D 7269-07 and a matrix material, wherein the matrix material comprises, preferably consists of a mixture comprising

- at least one self-crosslinking acrylic resin, and/or at least one crosslinkable acrylic resin, and
- at least one tackifier.

Surprisingly, the ballistic resistant article according to the present invention exhibits a considerably higher adhesion between the monolayers not only in the unaged state of the article but also after long-term aging the article in a climate at elevated values of temperature and relative humidity in comparison to a ballistic article of the same construction but with a matrix material without tackifier and/or in a chemically degrading atmosphere, e.g. in an oxygen atmosphere.

Furthermore, surprisingly the ballistic resistant article according to the present invention exhibits a considerably lower water pickup after water soak in comparison to a ballistic article of the same construction but with a matrix material without tackifier. And the article passes the gasoline soak test.

Finally, if according to a preferred embodiment of the ballistic resistant article of the present invention the plurality of fibrous layers is formed into a panel and the panel is joined to a plate of metal or ceramic resulting in a hard-ballistic article, minimal or even no delamination of the fibrous layers is observed after ballistic attack, whereas an article of the same construction but with a matrix material without tackifier exhibits light delamination of the fibrous layers. So, the ballistic resistant article according to the present invention exhibits a considerably higher structural integrity between the fibrous layers in comparison to a ballistic article of the same construction but with a matrix material without tackifier. The surprisingly high structural integrity of the fibrous layers in the ballistic resistant article according to the present invention is achieved together with an antiballistic capability of the inventive article measured as v50-values which both in the unaged and in the aged state, i.e. after long-term aging of the inventive article at elevated values of temperature and relative humidity are very similar or even identical compared to the respective v50-values of an article of the same construction but with a matrix material without tackifier.

DETAILED DESCRIPTION

Within the scope of the present invention the term "fibrous layers" means layers, which comprise fibers as one of its constituents.

Within the scope of the present invention the term "fibers" means an elongate body, the length dimension of which is much greater than the transverse dimensions of width and thickness. Accordingly, "fibers" includes monofilament fibers, multifilament fibers, ribbons, strips, staple fibers and yarns made from one or more of the foregoing. Especially preferred "fibers" mean multifilament yarns. The cross-sections of the "fibers" to be used in the present invention may vary widely. They may be circular, flat or oblong in cross-section. They also may be of irregular or regular shape having one or more regular or irregular lobes projecting from the longitudinal axis of e.g. a filament. Preferably the "fibers" exhibit a substantially circular cross- section.

Within the scope of the present invention the term "a plurality of fibrous layers" means at least two fibrous layers. However, depending on the intensity of the ballistic attack the ballistic resistant article of the present invention has to withstand, the number of fibrous layers constituting the plurality of fibrous layers can be selected by those skilled in the art and knowing the present invention. For a lot of ballistic attack situations a number of fibrous layers preferably ranging from 2 to 250 and more preferably ranging from 10 to 100 is sufficient.

Within the scope of the present invention the term "a network of fibers" means a plurality of fibers arranged into a predetermined configuration or a plurality of fibers grouped together to from a twisted or untwisted yarn, which yarns are arranged into a predetermined configuration. The fiber network can have various configurations. For example, the fibers or yarns may be formed as a felt or other nonwoven, knitted or woven into a network, or formed into a network by any conventional techniques.

According to a particularly preferred network configuration the network of fibers is a unidirectional alignment of the fibers, i.e. the fibers are unidirectionally aligned so that they are substantially parallel to each other along a common fiber direction.

Fibers useful to form the network of fibers in the ballistic resistant article according to the present invention are those having a strength of at least 800 mN/tex (1100 MPa) according to ASTM D 7269-07. Among said fibers aramid fibers are preferred. Within the scope of the present invention the term "aramid fibers" means fibers produced from an aromatic polyamide as the fiber-forming polymer. In said fiber forming polymer at least 85% of the amide (—CO—NH—) bonds are directly bound on two aromatic rings. Especially preferred aromatic polyamides are p-aramids. Among the p-aramids poly(p-phenylene terephthalamide) is the most preferred one. Poly(p-phenylene terephthalamide) results from the mol:mol polymerization of p-phenylene diamine and terephthalic acid dichloride. Fibers consisting e.g. of multifilament yarns made from poly(p-phenylene terephthalamide) can be obtained under the trade name Twaron® from Teijin Aramid (NL).

Further aramid fibers useful to form the network of fibers in the ballistic resistant article according to the present invention are those formed from an aromatic copolymer as the fiber-forming polymer. In the said aromatic copolymer p-phenylene diamine and/or terephthalic acid dichloride are partly or completely substituted by other aromatic diamines and/or dicarboxylic acid chlorides.

Within the scope of the present invention the term "matrix material" means a material, which in particular bonds fibers within a single fibrous layer to one another and thereby stabilizes the single fibrous layer.

The matrix material of the ballistic resistant article according to the present invention exhibits a matrix material, wherein the matrix material comprises a mixture comprising at least one self-crosslinking acrylic resin and/or at least one crosslinkable acrylic resin, and at least one tackifier.

Additionally said mixture may comprise formulation auxiliaries used by the manufacturers of the at least one self-crosslinking acrylic resin and of the at least one crosslinkable acrylic resin and of the at least one tackifier. For example, the at least one self-crosslinking acrylic resin and/or the at least one crosslinkable acrylic resin and/or the at least one tackifier may comprise one or more surfactants. Furthermore, the at least one self-crosslinking acrylic resin and/or at least one crosslinkable acrylic resin and/or the at least one tackifier may comprise small quantities of a wetting agent, defoaming agent, antioxidants, UV stabilizers and free radical scavengers.

Within the scope of the present invention the term "at least one self-crosslinking acrylic resin" means at least one polyacrylate having self-reactive sites built into the acrylic polymer chain that will crosslink at elevated temperatures. Thereby said self-reactive groups of adjacent polymer chains react with one another and chemically bind said adjacent polymer chains to form a cross-linked polymer. To speed the crosslinking reaction an acid or latent acid catalyst may be added.

Within the scope of the present invention the term "at least one crosslinkable resin" means at least one acrylic polymer, preferably at least one acrylic homopolymer, which does not exhibit self-reactive groups and therefore, needs the addition of an external crosslinking agent, such as a nitrogenous thermosetting resin to achieve the optionally desired crosslinking reaction.

The ballistic resistant article according to the present invention comprises, preferably consists of a mixture comprising at least one self-crosslinking acrylic resin, and/or at least one crosslinkable acrylic resin, and at least one tackifier.

So, with respect to the acrylic resin components the ballistic resistant article comprises several embodiments, which are described in the following.

In a first embodiment the resin comprises one self-crosslinking acrylic resin.

In a second embodiment the resin comprises two, three or more self-crosslinking acrylic resins.

In a third embodiment the resin comprises one crosslinkable acrylic resin.

In a fourth embodiment the resin comprises two, three or more crosslinkable acrylic resins.

In a fifth embodiment the resin is a mixture of at least one self-crosslinking acrylic resin with at least one crosslinkable acrylic resin. In this embodiment a high crosslinking density can be achieved within the said resin(s).

The at least one self-crosslinking acrylic resin and/or the at least one crosslinkable acrylic resin which—beside the at least one tackifier—are used to manufacture the matrix material of the ballistic resistant article of the present invention exhibit a glass transition temperature which preferably is in the range between −70° C. and 100° C., more preferred in the range between −50° C. and 30° C., and most preferred in the range between −30° C. and 20° C.

Within the scope of the present invention the term "at least one tackifier" means at least one chemical compound present in the matrix material of the ballistic resistant article and being homogenously distributed in said matrix material, thereby providing the matrix material with tack. And within the scope of the present invention the term "homogeneously distributed in said matrix material" means that the concentration of the at least one tackifier in every volume element of the matrix material is the same.

In a preferred embodiment of the ballistic resistant article according to the present invention the tackifier is selected from the group consisting of rosin resins which are derived from either tree stumps (wood resin), sap (gum rosin) or by-products of the paper making process (tall oil rosin), wherein the rosin resins may be rosin esters obtained by the reaction between rosin acids and alcohols, hydrogenated rosin esters obtained by hydrogenation of the rosin acid raw material or dimerized rosin resins obtained from dimerizing rosin acids or terpene resins derived from terpene feedstocks either from wood sources or from citrus fruit or hydrocarbon resins available from Neville Chemical Company, US under several designations, such as NP-10, NP-25, and FN-175.

In a preferred embodiment of the ballistic resistant article according to the present invention the tackifier is present in the matrix material in a weight percentage with respect to the weight of matrix material resin ranging from 1 wt. % to 20 wt. %, more preferred from 1.5 wt. % to 10 wt. % and most preferred from 2 wt. % to 6 wt. %. If said weight percentage of the tackifier is below 1 wt. % handling of the single fibrous layer during the manufacture of the ballistic resistant article of the present invention may become more complicated. For example, if a fibrous layer comprises a unidirectional alignment of fibers, said alignment may become instable within the single layer. If said weight percentage of the tackifier is above 20 wt. %, the ballistic article may become too stiff and the advantageous properties of the self-crosslinking and/or crosslinkable acrylic resin are lost.

The mixture of the at least one self-crosslinking acrylic resin and/or at least one crosslinkable acrylic resin, and the at least one tackifier which is used to manufacture the matrix material of the ballistic resistant article of the present invention can be applied in the form of an emulsion or in the form of a dispersion, e.g. as a latex dispersion. The medium of the emulsion or dispersion may be an organic medium or preferably is a waterborne medium.

If the mixture of the at least one self-crosslinking acrylic resin and/or at least one crosslinkable acrylic resin, and the at least one tackifier is used in the form of an emulsion, the emulsion may have been prepared by using an emulsifying agent selected from anionic, cationic, non-ionic, fatty acids or rosin acid soap as an emulsifying agent.

In preparing said mixture the following mixing sequence is preferably practiced:

Step 1: A self-crosslinking or a crosslinkable acrylic resin is provided, e.g. as an emulsion.

Step 2: Optionally another self-crosslinking or crosslinkable acrylic resin, e.g. as an emulsion, is blended with the self-crosslinking or crosslinkable acrylic resin of step 1.

Step 3: At least one tackifying agent, e.g. as a waterborne dispersion or emulsion, is added to the acrylic resin(s) with stifling.

Step 4: Optionally at least one crosslinking agent is added to the [acrylic resin(s)/tackifier(s)]-mixture.

If the at least one crosslinkable acrylic resin is applied in the form of a waterborne dispersion, e.g. the cross-linking agent Cymel® 385 available from Cytec (Woodland Park, N.J., USA) can be used.

Furthermore, the emulsion or dispersion of the at least one self-crosslinking acrylic resin and/or at least one crosslinkable acrylic resin and the at least one tackifier may comprise small quantities of a wetting agent, defoaming agent, antioxidants, UV stabilizers and free radical scavengers.

In a further preferred embodiment of the ballistic resistant article according to the present invention the matrix material—besides the at least one tackifier—may comprise a first self-crosslinking acrylic resin having a first glass transition temperature, Tg(1st sc), and a second self-crosslinking acrylic resin having a second glass transition temperature, Tg(2nd sc), wherein Tg(1st sc)>Tg(2nd sc). In this case Tg(1st sc) may be in a range, which is preferably from −20° C. to 40° C., more preferably in a range from −10° C. to 30° C., and most preferable in a range from 0° C. to 20° C., and Tg(2nd sc) may be in a range, which is preferably from −50° C. to −10° C., more preferably in a range from −40° C. to −10° C., and most preferable in a range from −30° C. to −20° C.

In an especially preferred embodiment of the ballistic article of the present invention the first self-crosslinking acrylic resin has Tg(1st sc)>0 and the second self-crosslinking acrylic resin has Tg(2nd sc)<0.

In a further especially preferred embodiment of the ballistic article of the present invention the first self-crosslinking acrylic resin has Tg(1st sc)<0 and the second self-crosslinking acrylic resin has Tg(2nd sc)<0.

In a further especially preferred embodiment of the ballistic article of the present invention the first self-crosslinking acrylic resin has Tg(1st sc)>0 and the second self-crosslinking or crosslinkable acrylic resin has Tg(2nd sc)>0.

In a further especially preferred embodiment of the ballistic article of the present invention the first self-crosslinking acrylic resin has Tg(1st sc)<0 and the second self-crosslinking or crosslinkable acrylic resin has Tg(2nd sc)<0.

In still a further embodiment of the ballistic resistant article according to the present invention the matrix material may comprise a first crosslinkable acrylic resin having a first glass transition temperature, Tg(1st cl), and a second crosslinkable acrylic resin having a second glass transition temperature, Tg(2nd cl), wherein Tg(1st cl)>Tg(2nd cl). In this case Tg(1st cl) may be in a range, which is preferably from −20° C. to 40° C., more preferably in a range from −10° C. to 30° C., and most preferably in a range from 0° C. to 20° C., and Tg(2nd cl) may be in a range, which is preferably from −50° C. to −10° C., more preferably in a range from −40° C. to −10° C., and most preferably in a range from −30° C. to −20° C.

In an especially preferred embodiment of the ballistic article of the present invention the first crosslinkable acrylic resin has Tg(1st cl)>0 and the second crosslinkable acrylic resin has Tg(2nd cl)<0.

In a further especially preferred embodiment of the ballistic article of the present invention the first crosslinkable acrylic resin has Tg(1st cl)<0 and the second crosslinkable acrylic resin has Tg(2nd cl)<0.

In a further especially preferred embodiment of the ballistic article of the present invention the first crosslinkable acrylic resin has Tg(1st cl)>0 and the second crosslinkable acrylic resin has Tg(2nd cl)>0.

Self-crosslinking acrylic resins and crosslinkable acrylic resins are available e.g. from Rohm and Haas, Midland, Mich., (USA) under the trade names Rhoplex® (trade name in USA) and Primal Eco®.

In the ballistic resistant article according to the present invention the fibers have a weight wf, the matrix material has a weight wm and a weight percentage of the matrix material with respect to (wf+wm) preferably is from 5 wt. % to 50 wt. %, more preferably from 10 wt. % to 30 wt. % and most preferably from 12 wt. % to 20 wt. %.

In a further preferred embodiment of the ballistic resistant article according to the present invention the areal density of the fibers in a single fibrous layer ranges from 10 g/m$^2$ to 250 g/m$^2$, more preferable from 60 g/m$^2$ to 200 g/m$^2$ and most preferably from 100 g/m$^2$ to 160 g/m$^2$.

In a further preferred embodiment of the ballistic resistant article according to the present invention the total areal density of a single fibrous layer ranges from 11 g/m$^2$ to 350 g/m$^2$, more preferable from 60 g/m$^2$ to 280 g/m$^2$ and most preferably from 111 g/m$^2$ to 230 g/m$^2$.

In a further preferred embodiment of the ballistic resistant article according to the present invention the plurality of fibrous layers is formed into a panel and the panel is joined to a plate of metal or ceramic resulting in a hard-ballistic resistant article which exhibits the advantageous properties described before. However, the advantageous properties of the ballistic resistant article according to the present invention can also be seen, if a panel formed of a plurality of fibrous layers without having been joined to a plate of metal or ceramic is subjected to a ballistic attack: A high degree of structural integrity ranging from no or very light bulging to light bulging with some delamination is observed in said panel.

In a further preferred embodiment of the ballistic resistant article according to the present invention a scrim comprising, preferably consisting of a thermoplastic material is situated between the fibrous layers.

In a first preferred alternative the scrim is a mesh, wherein the percentage of the area of the mesh openings with respect to the total area of the scrim is in the range of 40% to 98%, more preferably in the range of 65 to 90% and most preferred in the range of 75 to 85%. Preferably the thermoplastic polymer constituting the scrim is a polyolefine, a copolyamide or a polyurethane. Preferably the scrim has an areal density in the range of 1 g/m$^2$ to 20 g/m$^2$, more preferably in the range of 1 g/m$^2$ 10 to g/m$^2$ and most preferred in the range of 2 g/m$^2$ to 6 g/m$^2$.

In a second preferred alternative the scrim is a fleece consisting of a thermoplastic material, which is preferably a thermoplastic polymer, e.g. a polyolefine, a copolyamide or a polyurethane.

In said preferred embodiments of the ballistic resistant article of the present invention containing a scrim between the fibrous layers the amount of the at least one tackifier can be reduced for example to an extent, that the adhesion between adjacent fibrous layers is the same as without a scrim.

In a further preferred embodiment of the ballistic resistant article according to the present invention the matrix material additionally to the at least one self-crosslinking acrylic resin and/or the at least one crosslinkable acrylic resin and the at least one tackifier may comprise at least one carboxylated and/or non-carboxylated styrene butadiene random copolymer resin with or without at least one tackifier.

A process to manufacture a ballistic resistant article according to the present invention shall be explained for a preferred embodiment, wherein each fibrous layer of the plurality of fibrous layers consists of a network of fibers, which is a unidirectional alignment of yarns. In this case the process at least comprises the steps (1)-(3) described in the following. With the aid of said description those skilled in the art will be able to transfer the process to manufacture a ballistic resistant article according to the present invention to include networks of fibers other than unidirectional alignments of yarn, e.g. felts or other nonwoven fabrics and knitted or woven fabrics.

Manufacture of a single unidirectional fibrous layer:

Yarns having a strength of at least 800 mN/tex (1100 MPa) according to ASTM D 7269-07 are unidirectionally aligned so that they are substantially parallel to each other along a common fiber direction. Then the yarns are coated with a matrix material which comprises, preferably consists of a mixture comprising at least one self-crosslinking acrylic resin and/or at least one crosslinkable acrylic resin, and at least one tackifier in order to bond fibers predominantly within a single fibrous layer to one another and there-by to stabilize the single unidirectional layer with the aid of the matrix material. In preferred embodiments of the manufacture of a single unidirectional fibrous layer the yarns may be spread either before or during or after coating with the matrix material. The coating can be achieved e.g. by reverse roll coating, dipping, spraying or by any other technique which is capable to stabilize the single unidirectional fibrous layer, i. e. to adhere the fibers via the matrix material within the unidirectional layer. The matrix-coating may be partly of fully encapsulating the fibers and does not need to be uniform across a cross-section of the unidirectional layer. For example the matrix concentration may be higher on top and bottom of the unidirectional layer than it is towards the core of the unidirectional layer. There may also be more matrix material on top of the unidirectional fibrous layer compared to the bottom of the unidirectional fibrous layer and vice versa. After the unidirectional fibrous layer has been made a cross-linking reaction of the self-crosslinking acrylate resin and/or of the crosslinkable acrylate resin is performed e.g. by increasing the temperature to induce the cross-linking between reactive sites in adjacent polymer chains of the self-cross-linking acrylate resin and/or to additionally link adjacent polymer chains by the crosslinker present in the crosslinkable acrylic resin. However, it is also possible not to perform said crosslinking reaction(s) in step (1) but to perform said crosslinking reaction(s) in one or both of the following steps (2) and (3).

(2) Manufacture of an adherent cross-ply from at least two unidirectional single fibrous layers:

Two unidirectional fibrous layers resulting from step (1) are cross-plied at a cross-plying angle ranging from 0° to 90°, the latter being preferred. Then, the two cross-plied unidirectional fibrous layers are adhered to one another e.g. by laminating, pressing or by any other procedure which is capable to generate adhesion between the two unidirectional fibrous layers to yield an adherent two-layer cross-ply. For this purpose a temperature range from 50° C. to 225° C., a pressure range from 0.5 to 10 bars and a time range from 5 seconds to 200 seconds may be applied depending e.g. on the tackiness of the applied matrix material and the chosen tackifying agent. Alternatively, more than two unidirectional fibrous layers can be manufactured into an adherent cross-ply. For example four unidirectional fibrous layers may be adhered to one another and the resulting adherent cross-ply may exhibit a sequence of cross-plying angles being e.g. (0°/90°/0°/90°) or (0°/90°/90°/0°) or 90°/0°/0°/90°) or (0°/0°/90°/90°).

During the manufacture of the adherent cross-ply a cross-linking reaction may be performed as described in step (1). Within the scope of the process according to the present invention the term "during cross-plying" means at any suitable stage of the cross-plying procedure, e.g. during the laminating procedure or during the pressing procedure.

(3) Manufacture of a consolidated panel and optionally of a hard-ballistic resistant article:

A number of adherent e.g. two-layer cross-plies resulting from step (2) sufficient to withstand the intended ballistic attack is stacked and the resulting stack is consolidated into a panel e.g. with the aid of a press to result in an consolidated panel. The consolidation can take place e.g. by pressing in a isostatic press at temperatures between 60° C. and 300° C., more preferable between 120° C. and 170° C. at a pressure maintained at a value of e.g. 25 bar to 500 bar, preferably from 25 bar to 100 bar for a time being e.g. between 15 minutes and 100 minutes. If a cross-linking reaction shall be performed as described in step (1) the chosen values of temperature, pressure and time should allow for the cross-linking reaction to occur in the desired extent. Optionally, the panel in the press is cooled down to about 50° C., while still under pressure. The resulting consolidated panel exhibits an intended side of ballistic attack and an inner side. The consolidation can be performed using the same or different adherent cross-plies. If different adherent cross-plies are used the adherent cross-plies closer towards the intended side of ballistic attack may include a resin having different mechanical properties, e.g. a different Tg, than adherent cross-plies which are farther from the intended side of ballistic attack. In the latter embodiment the harder and stiffer adherent cross-plies, i.e. adherent cross-plies having a self-crosslinking acrylic resin and/or a crosslinkable acrylic resin with a higher Tg, may be placed towards the intended side of ballistic attack, whereas the less harder and more flexible adherent cross-plies, i.e. adherent cross-plies having a self-crosslinking acrylic resin and/or a crosslinkable acrylic resin with a lower Tg, may be placed farther from the intended side of ballistic attack, e.g. on the inner side of the consolidated panel.

(4) In any case the resulting consolidated panel can be used as such as ballistic resistant article or in an optional process step (4) can be joined to a plate of metal or ceramic to yield a hard-ballistic resistant article.

The crosslinking reaction described above may be performed only in step (1) or only in step (2) or only in step (3) of the process according to the present invention.

However, in a further embodiment of the process according to the present invention the cross-linking reaction can take place in step (1) and in step (2) of the process according to the present invention. In this embodiment a partial cross-linking of the self-crosslinking acrylic resin and/or of the crosslinkable acrylic resin is performed in step (1) and in step (2) the cross-linking is completed.

In still a further embodiment of the process according to the present invention the cross-linking reaction can take place in each of step (1), step (2) and step (3) of the process according to the present invention. In this embodiment a partial cross-linking of the self-crosslinking acrylic resin and/or of the crosslinkable acrylic resin may be performed in step (1), in step (2) the degree of partial cross-linking may be further increased and in step (3) the cross-linking is completed.

The present invention is explained in more detail in the following examples and comparative examples.

COMPARATIVE EXAMPLE 1 a) Manufacture of a Single Unidirectional Fibrous Layer (1L-UD)

Poly(p-phenylene terephthalamide) multifilament yarns (Twaron® type 1000; 3360 dtex f2000; Manufacturer: Teijin Aramid, NL) were taken from a creel and passed through a reed thus aligned substantially parallel to one another. The substantially parallel yarns were coated with a pre-diluted self-crosslinking aqueous acrylic resin emulsion (Rhoplex® E-358; solid content=60.0 wt. %, pH=7.0; viscosity=300 cps (Brookfield, spindle LV-3, 60 rpm, 25° C.); Tg=+8° C.; non-ionic emulsifying system; Manufacturer: Rohm and Haas, Midland, Mich., USA) using a reverse roll coater. The pre-diluted emulsion was obtained by diluting Rhoplex® E-358 to a solid content of 25 wt. % using tap water. The spread and coated yarns were laid up on a silicone coated release paper and dried by passing over a hot-plate set at a temperature of 120° C. resulting in a single unidirectional fibrous layer (1L-UD).

The resin concentration in the 1L-UD was 13±1 wt. % based on the total weight of the 1L-UD, i.e. with respect to the weight of yarn+matrix without moisture, i.e. the weight of the 1L-UD dried to a water content of practically 0 wt. %, that means a water content of well below 0.5 wt. %. The areal density of the poly(p-phenylene terephthalamide) multifilament yarns in the 1L-UD was 110±5 g/m$^2$. The total areal density including equilibrium moisture content of the 1L-UD was 130±10 g/m$^2$ depending on resin loading and equilibrium moisture content.

b1) Manufacture of a Laminated Cross-ply from Two 1L-UDs

Two 1L-UDs resulting from a) were cross-plied at a cross-plying angle of 90°. The cross-plied 1L-UDs were laminated in a flat belt-laminator having a heating-zone followed by a pressing-zone. In the heating-zone the cross-plied 1L-UDs were heated for 15 seconds in contact with 120° C. hot belts and in the pressing zone the heated cross-plied 1L-UDs were pressed at 3.5 bar calander roll pressure and finally cooled to room temperature by contact with cooled belts resulting in a laminated cross-ply from two 1L-UDs.

b2) Manufacture of a Pressed Cross-ply from Two 1L-UDs

Two 1L-UDs resulting from a) were cross-plied at a cross-plying angle of 90°, put into a press and pressed—at 120° C. and 10 bar for 20 minutes (results see table 2, example 1'-1) and—at 170° C. and 10 bar for 20 minutes (results see table 2, example 1'-2). In both of the above alternative embodiments the two 1L-UDs remained in the press under pressure until the press was cooled down to 50° C. Then the press was opened and a pressed cross-ply from two 1L-UDs was obtained.

c) Adhesion Between the 1L-UDs in the Cross-plies from b1) and b2)

The adhesion between the 1L-UDs in the cross-plies resulting from b1) and b2) was measured directly as obtained from the respective cross-plying procedure and called adhesion(0). A part of the cross-plies resulting from b1) and b2) were first inserted into a climate chamber at 65° C. and 80% relative humidity for 21 weeks, then taken out of the climate chamber, conditioned at 20° C. and 65% relative humidity for 24 h and finally the adhesion between the 1L-UDs in the cross-plies was measured and called adhesion(21).

To measure the adhesion between the 1L-UDs in the cross-plies resulting from b1) and b2) a sample was cut from the respective cross-ply in a 45° direction with respect to the yarns in both plies. The 45°-direction was chosen to prevent the individual yarns in the plies to be clamped-in by two clamps simultaneously. In this way only the shear stress at the interface between the two UD-layers and the shear stress within the ply were measured, but not the mechanical properties of the yarn. The sample with dimensions 50×200 mm was placed into an Instron tensile tester equipped with flat clamps and a 10 kN load cell. A clamp distance (gauge length) of 100 mm was applied and a stress-strain curve was measured. From this curve the maximum measured load (in N/m) was taken as a measure for the degree of adhesion between the 1L-UDs in the respective cross-plies.

d) Water Pickup After Water Soak

The water pick of a laminated cross-ply resulting from b1) was measured directly as obtained from the cross-plying procedure.

To measure the water pickup the laminated cross-ply resulting from b1) was first weighted to yield the weight w1 and then soaked in an aqueous solution of 0.3 wt. % sodium chloride for 24 h at room temperature followed by 15 minute drip dry under ambient temperature and relative humidity, i.e. the cross-ply was hung for 15 minutes under the said conditions. Then the drip dried cross-ply was weighted to yield the weight w2 and the water pick up was calculated according to the equation (1).

$$\text{water pick up}=([w2-w1]/w1)\cdot 100\ (\%) \quad (1)$$

e) Gasoline Soak Test

The gasoline soak test of laminated cross-plies resulting from b1) was measured directly as obtained from the cross-plying procedure.

To perform the gasoline soak test the laminated cross-plies resulting from b1) were soaked in diesel fuel for 4 hours followed by 15 minute drip dry under ambient temperature, i.e. the cross-plies were hung for 15 minutes under the said condition. For the pass/non pass evaluation the following criteria were applied: To pass the test, the laminated cross-plies resulting from b1) after having been subjected to the gasoline soak have to exhibit more than 75% adhesion retention, i.e. more than 75% of adhesion(0), no further loss of adhesion when flexed.

COMPARATIVE EXAMPLE 2

Comparative example 2 was performed as comparative example 1 but with the difference that a standard acrylic resin available from every manufacturer of acrylic resins was applied for the matrix material. The standard acrylic resin, i.e. an acrylic polymer which is neither self-crosslinking nor does contain a crosslinking agent, was applied as a dispersion (solid content=49-51%, viscosity=800 cps (Brookfield, spindle LV-2, 20 rpm, 23° C.); Tg=5° C.).

The results of adhesion between the 1L-UDs after 21 weeks in the climate chamber (adhesion(21)) are shown in table 1 for the laminated cross-plies and in table 2 for the pressed cross-plies.

TABLE 1

| | Laminated cross-ply with resin | Adhesion(21) (N/m) |
|---|---|---|
| Comparative example 1 | Rhoplex ® E-358 | 1530 |
| Comparative example 2 | Standard acrylic resin | 1170 |

TABLE 2

| | Pressed cross-ply with resin | Adhesion(21) (N/m) |
|---|---|---|
| Comparative example 1'-1 | Rhoplex ® E-358 | 37600 |
| Comparative example 2'-1 | Standard acrylic resin | 29400 |
| Comparative example 1'-2 | Rhoplex ® E-358 | 37500 |

From the comparison of comparative example 1 with comparative example 2 in table 1 it can be seen that after 21 weeks aging at 65° C. and 80% relative humidity the adhesion between the laminated 1L-UDs of the cross-ply with the self-crosslinking acrylic resin of the Rhoplex® E-358 type is 1530 N/m, i.e. 31% higher than the adhesion between the laminated 1L-UDs of the cross-ply with the comparative standard acrylic resin.

From the comparison of comparative example 1'-1 with comparative example 2'-1 in table 2 it can be seen that after 21 weeks aging at 65° C. and 80% relative humidity the adhesion between the pressed 1L-UDs of the cross-ply with the self-crosslinking acrylic resin of the Rhoplex® E-358 type is 37600 N/m, i.e. 28% higher than the adhesion between the pressed 1L-UDs of the cross-ply with the comparative standard acrylic resin. Practically the same adhesion between the pressed 1L-UDs of the cross-ply with the self-crosslinking acrylic resin of the Rhoplex® E-358 type was measured with the cross-ply of comparative example 1'-2.

Furthermore, the water pick-up of a comparative laminated cross-ply with Rhoplex® E-358 was found to be 18.6%, whereas the water pick-up of a laminated cross-ply with the comparative standard acrylic resin was found to be 22.7%.

Furthermore, the comparative laminated cross-ply with Rhoplex® E-358 passed the gasoline soak test, whereas the laminated cross-ply with the comparative standard acrylic resin did not pass said test.

COMPARATIVE EXAMPLE 3 a) Manufacture of 8 kg/m$^2$ Pressed Panels

Single unidirectional fabric layers (1L-UDs) were manufactured as described in comparative example 1a). Inter alia that means that Rhoplex® E-358 was used as the self-crosslinking acrylic resin. From the 1L-UDs laminated cross-plies were manufactured as described in comparative example 1b1), i.e. they were laminated at 120° C. and 3.5 bar for 15 seconds. The cross-plies were stacked until a panel with an areal density of 8 kg/m$^2$ was obtained. The stacked panel was put into a press and pressed at 170 ° C. and 50 bar for 20 minutes. The panel remained in the press under pressure until the press was cooled down to 50° C. Then the press was opened and a pressed panel was obtained. In this manner six pressed panels were manufactured.

Three of said pressed panels were directly—i.e. in an unaged state—further processed into three hard-ballistic articles as described in part b) immediately below. The other three of said pressed panels were first aged, i.e. stored for 3 months in a climate chamber at 65° C. and at a relative humidity of 80% and then further processed into three hard-ballistic articles as described in part b) immediately below.

b) Manufacture of Hard-ballistic Articles

Each of the pressed panels resulting from a) was joined to a 4 mm thick Secure 500 steel front strike plate (500×500 mm) available from ThyssenKrupp Steel, DE. The areal density of the steel plate was 32 kg/m$^2$. For the joining operation the joining side of the panel was coated with Sika® 209 as primer and then both the steel plate and the joining side of the panel were coated with Sikaflex® 228 both available from SIKA Deutschland GmbH, DE.

c) v50 Measurement of the Hard-ballistic Articles and Delamination Behaviour

The hard-ballistic articles resulting from b) were evaluated for their anti-ballistic capability by measuring v50, i.e. the velocity in m/s, at which 50% of the projectiles were stopped. The projectiles used were NH level 3 threat 7.62×51 mm soft-core (NATO M80 ball) 0° obliquity. The evaluation of v50 is described e.g. in MIL STD 662F.

Furthermore, the delamination behaviour of the 1L-UDs in the pressed panel behind the steel plate was evaluated by visual inspection. "Minimal delamination" means that less than 3% of the 1L-UD layers in the pressed panel were delaminated. "Light delamination" means that less than 5% of the 1L-UD layers in the pressed panel were delaminated. "Interior delamination" means that more than 30% of the 1L-UD layers in the pressed panel were delaminated. "Very strong interior delamination" means that more than 70% of the 1L-UD layers in the pressed panel were delaminated.

Both interior delamination and even more very strong interior delamination will have a drastic negative effect on the multihit capability of the anti-ballistic article.

EXAMPLE 1

Example 1 was performed as comparative example 3 with the difference that a mixture of 90 wt.-% Rhoplex E-358 and 10 wt.-% Aquatac® 6025 was used to form the matrix material. Aquatac® 6025 is a waterborne dispersion containing about 58 wt.-% rosin ester as a tackifier, about 39 wt.-% water and less than 4 wt.-% surfactant.

COMPARATIVE EXAMPLE 4

Comparative example 4 was performed as comparative example 3 but with the difference that standard acrylic resin was applied for the matrix material.

The results of comparative example 3, example 1 and comparative example 4 are shown in Table 3.

TABLE 3

| | Hard-ballistic article (8 kg/m$^2$ pressed panel behind a steel front strike plate) with resin | $v_{50}$ (m/s) unaged | Delamination Unaged | $v_{50}$ (m/s) aged | Delamination aged |
|---|---|---|---|---|---|
| Comparative example 3 | Rhoplex ® E-358 | 823 | light | 832 | light |
| Example 1 | 90 wt.-% Rhoplex ® E-358<br>10 wt.-% Aquatac ® 6025 | 825 | minimal | 823 | minimal |
| Comparative example 4 | Standard acrylic resin | 830 | interior delamination | 832 | interior delamination |

Unaged panels: As can be seen from table 3 in the unaged state the v50-values of the inventive hard-ballistic article according to example 1 with 90 wt.-% Rhoplex® E-358 resin and 10 wt.-% Aquatac® 6025 exhibit practically the same v50-values as the comparative hard-ballistic articles according to comparative examples 3 and 4 within the experimental error of the v50-determination (The maximal error range is about ±15 m/s.) However, the delamination in the pressed panels of the inventive hard-ballistic article according to example 1 is only minimal, i.e. less than 3% of the 1L-UD layers in the pressed panels are delaminated. In contrast in the pressed panels of the comparative hard-ballistic articles according to comparative example 3 light delamination was observed, i.e. less than 5% of the 1L-UD layers in the pressed panels are delaminated. And in the pressed panels of comparative example 4 even interior delamination was observed, i.e. more than 30% of the 1L-UD layers in the pressed panes are delaminated Aged panels: Table 3 exhibits that in the aged state the v50-value of the inventive hard-ballistic article according to example 1 with 90 wt.-% self-crosslinking Rhoplex® E-358 acrylate resin and 10 wt.-% Aquatac® 6025 is practically identical with the v50-value of the comparative hard-ballistic articles according to comparative examples 3 and 4. However, the delamination in the pressed and aged panels of the inventive hard-ballistic article is only minimal, i.e. less than 3% of the 1L-UD layers in the pressed panels are delaminated. In contrast in the pressed and aged panels according to comparative example 3 light delamination was observed, i.e. less than 5% of the 1L-UD layers in the pressed panels are delaminated. And in the pressed and aged panels of comparative example 4 even interior delamination was observed, i.e. more than 30% of the 1L-UD layers in the pressed panel are delaminated.

COMPARATIVE EXAMPLE 4A

Four pressed panels each of them exhibiting an areal density of 8 kg/m$^2$ were manufactured as in comparative example 3, i.e. with Rhoplex E-358, without tackifier. Said panels were aged, i.e. stored for 3 months in a climate chamber at 65° C. and at a relative humidity of 80%.

The aged panels were joined to a 7 mm thick ALOTEC® 96 SB ceramic front plate (500×500 mm) obtainable from Etec Gesellschaft für Technische Keramik GmbH, DE, to produce four hard-ballistic articles. The areal density of the ceramic plate was 26.3 kg/m$^2$. For the joining operation both the ceramic plate and the joining side of the panel were coated with Sika® 209 as primer and then both with Biresin® U-1305. Both Sika® 209 and Biresin® U-1305 are available from SIKA Deutschland GmbH, DE.

The resulting four hard-ballistic articles were evaluated for their anti-ballistic capability by measuring v50 as described in comparative example 3c) resulting in v50=929 m/s and interior delamination, i.e. more than 30% of the 1L-UD layers behind the ceramic plate are delaminated.

EXAMPLE 2

Example 2 was conducted as comparative example 4a with the difference that the 4 pressed panels now were manufactured with a mixture of 90 wt.-% Rhoplex® E-358 and 10 wt.-% Aquatac® 6025 to constitute the matrix material.

The resulting four hard-ballistic articles were evaluated for their anti-ballistic capability by measuring v50 as described in comparative example 3c) resulting in v50=810 m/s but only minimal delamination, i.e. less than 3% of the 1L-UD layers behind the ceramic plate are delaminated.

EXAMPLE 3 a) Manufacture of a Single Unidirectional Fibrous Layer (1L-UD)

Poly(p-phenylene terephthalamide) multifilament yarns (Twaron® type 1000; 3360 dtex f2000; Manufacturer: Teijin Aramid, NL) were taken from a creel and passed through a reed thus aligned substantially parallel to one another. The substantially parallel yarns were dipped in a bath containing a resin emulsion. The resin emulsion consisted of a mixture of 90 wt.% Rhoplex® E-358 and 10 wt.% of the tackifier Aquatac® 6025 (Manufacturer of the latter: Arizona Chemicals, USA). The spread yarns coated with the emulsion were laid up on a silicone coated release liner and then dried using an oven set at 120° C. for 2 to 4 minutes resulting in a single unidirectional fabric layer (1L-UD).

The resin concentration in the 1L-UD was in the range of 15.5 to 19 wt. % based on the total weight of the 1L-UD, i.e. with respect to the weight of yarn+matrix. The areal density of the poly(p-phenylene terephthalamide) multifilament yarns in the 1L-UD was 110±5 g/m$^2$. The total areal density of the 1L-UD was in the range of 121 to 137 g/m$^2$.

b) Manufacture of a Laminated Cross-ply from Two 1L-UDs

Two 1L-UDs resulting from a) were cross-plied at cross-plying angle of 90°±5°. The cross-plied 1L-UDs were laminated in a cross-plying unit using a multi step process. In the first step, the cross-plied 1L-UDs were heated for 5 to 15 seconds in close contact with a 92.5° C. hot platen without applying any pressure. Then a pressure of around 1.1 bar was applied for 5 to 25 seconds and finally cooled to room temperature by ambient air resulting in a laminated cross-ply from two 1L-UDs.

c) Manufacture of 19.5 kg/m$^2$ Pressed Panels

A laminated cross-ply resulting from b) was stacked until a panel with dimensions 381×381 mm with an areal density of 19.5 kg/m$^2$ was obtained. The stacked panel was transferred into a press and pressed for 30 minutes at a temperature of 135° C. under a pressure of 30 bars. The panel remained in the press under pressure until the press was cooled down to 30° C. Then the press was opened and a pressed panel was obtained.

d) v50 Measurement of the Hard-ballistic Articles and Delamination Behaviour

The pressed panel resulting from c) was evaluated for its antiballistic capability by measuring v50 using a 30 cal FSP threat (as per MIL-P-46593A) weighting 2.851 g.

Furthermore, the delamination behaviour of the pressed panel was evaluated by visual inspection. The results are shown in table 4.

COMPARATIVE EXAMPLE 4B

Comparative example 4b was conducted as example 3 but with the difference that the matrix material consisted of 100 wt.-% Rhoplex® E-358, i.e. no tackifier was applied. The results are shown in table 4.

TABLE 4

| | Resin | $v_{50}$ (m/s) | Delamination |
|---|---|---|---|
| Example 3 | 90 wt. % Rhoplex ® E-358<br>10 wt. % Aquatac ® 6025 | 775 ± 25 | very light to no bulging |
| Comparative example 4 b | 100 wt.-%<br>Rhoplex ® E-358 | 761 ± 17 | light bulging |

Table 4 shows that the v50-value of the panel containing 90 wt. % Rhoplex® E-358 and 10 wt. % of the tackifier Aquatac® 6025 is 775±25 m/s and that the structural integrity of the panel is significantly higher than that of the comparative example 4b, i.e. the panel of example 3 did not show any delamination but merely exhibited very light to no bulging, whereas the panel of comparative example 4b exhibited light bulging at the same v50-value within the error range of the v50-determination.

COMPARATIVE EXAMPLE 5 a) Manufacture of a Two-ply Composite

A fabric having the construction
plain weave, 1×1,
poly(-p-phenylene terephthalamid) multifilament yarn (Twaron® 2040 1100 dtex
31×31 (31 yarns per inch both in warp and in weft), and
an areal density of 289 g/m$^2$
was used.

From said fabric a fabric piece of 1 inch×8 inch (2.54 cm×20.32 cm) was cut. The fabric piece was placed on paper and the top section of the fabric piece width was taped with a 0.25 to 0.5 inch margin.

2-3 ml of an self-crosslinking aqueous acrylic resin emulsion (Rhoplex® E-358, solid content=60.0 wt.-%, pH=7, viscosity=300 cps (Brookfied, spindle LV-3, 60 rpm, 25° C.), Tg=+8° C., nonionic emulsifying system, Manufacturer: Rohm and Haas, Midland, Mich., USA) were slowly dispensed besides the tape. Then the emulsion was drawn down by using a 14 Meyer rod to apply a thin coating on the fabric. Then another 2-3 ml of Rhoplex® E-358 were slowly dispensed besides the tape and drawn down by using a 14 Meyer rod resulting in a coated fabric piece. In this manner two coated fabric pieces were prepared.

Said two coated fabric pieces were placed with the coated side faces to each other, heat consolidated at a temperature of 131° C., a pressure of 4.9 bar for 1 minute and allowed to cool down to room temperature to result in a two ply composite having an areal density of 649 g/m$^2$ and the weight percentage of the resin was 12 wt.-%. During said heat consolidation the Rhoplex® E-358 diffused into the woven fabric, so that the Rhoplex® E-358 resin bonds the fibers within a single woven fabric.

In the manner described above 6 two-ply composites were manufactured.

3 of said composites were stored at room temperature (20° C.) in air at normal pressure.

b) Accelerated Aging 3 of said composites were subjected to accelerated chemical and thermal aging according to ASTM D572-04 at 70° C., 300 psi (20.7 bar) in 99.7% oxygen for a duration of 5 days and 10 days.

c) Adhesion Between the Woven Fabrics in the Two Ply Composites

The adhesion between the woven fabrics in the two ply composites in the unaged and in the aged state, respectively was measured according to ASTM 1876-00 and is given in units of gram-force (1 gram-force=9.807 mN) as an arithmetical average of the respective 3 composites together with the standard deviation.

To measure the adhesion, a ½ inch section of the laminate along the length direction is separated. Once the two layers have been separated, the test specimen is loaded into the clamps of the testing apparatus so that one layer material is between each clamp. The laminate is centered on the clamp faces. Next the peel load at constant head speed of 10 inch/minute to an extension of 6 inches is applied. The reported adhesion value is the average value based on 5 peaks and 5 troughs.

The two-ply composites each having an areal density of 649 g/m$^2$ exhibited adhesion results shown in table 5.

EXAMPLE 4

Example 4 was conducted as comparative example 5 with the only difference that in step a) a mixture of 90 wt.-% Rhoplex® E-358 and 10 wt.-% Aquatac® 6025 was used. Aquatac® 6025 is a waterborne dispersion containing about 58 wt.-% rosin ester, about 39 wt.-% water and less than 4 wt.-% surfactant. The resulting two-ply composites had an areal density of 649 g/m$^2$ and the weight percentage of the matrix material was 12 wt.

-%. The adhesion results are shown in table 5.

EXAMPLE 5

Example 5 was conducted as example 4 with the only difference that in step a) a mixture of 80 wt.-% Rhoplex® E-358 and 20 wt.-% Aquatac® 6025 was used. The resulting two-ply composites had an areal density of of 649 g/m$^2$ and the weight percentage of the matrix material was 12 wt.-%.

The adhesion results are shown in table 5.

The results shown in table 5 can be summarized as follows.

Comparison of comparative example 5 with examples 4 and 5 shows that after 5 days at 20° C. in air at normal pressure the adhesion between the woven fabrics of the two-ply composites increases, if 10 wt.-% of the self-crosslinking acrylic resin Rhoplex® E-358 are substituted by 10 wt.-% of the tackifier Aquatac® 6025. This adhesion increase is achieved both with composites stored 5 day at 20° C. in air at normal pressure and with composites stored 5 days in 99.7% 02 at 20.7 bar. Example 5 shows that a further increase of the tackifier content to 20 wt.-% does not further increase the adhesion between the woven fabrics of the two-ply composites.

TABLE 5

| | Resin | Adhesion after 5 d at 20° C., air, normal pressure [gram-force] | Adhesion after 5 d at 70° C., 99.7% $O_2$, 20.7 bar [gram-force] |
|---|---|---|---|
| Comparative example 5 | 100 wt. % Rhoplex ® E-358 | 3593 ± 912 | 3287 ± 822 |
| Example 4 | 90 wt. % Rhoplex ® E-358 10 wt.-% Aquatac ® 6025 | 3873 ± 1073 | 3853 ± 397 |
| Example 5 | 80 wt. % Rhoplex ® E-358 20 wt.-% Aquatac ® 6025 | 3713 ± 345 | 3137 ± 745 |

The invention claimed is:

1. A ballistic resistant article comprising a plurality of fibrous layers, each of said layers comprising a network of fibers, wherein the fibers have a strength of at least 800 mN/tex (1100 MPa) according to ASTM D 7269-07 and a matrix material, wherein the matrix material comprises a mixture comprising at least one self-crosslinking acrylic resin and/or at least one crosslinkable acrylic resin, and at least one tackifier providing the matrix with tack, wherein the at least one tackifier is present in the matrix material in a weight percentage with respect to the weight of the matrix material ranging from 1 wt. % to 20 wt. %.

2. The ballistic resistant article according to claim 1, wherein the tackifier is selected from the group consisting of rosin resins or terpene resins or hydrocarbon resins.

3. The ballistic resistant article according to claim 1, wherein the network of fibers is a unidirectional alignment of the fibers.

4. The ballistic resistant article according to claim 1, wherein the fibers are aramid fibers.

5. The ballistic resistant article according to claim 1, wherein the fibers have a weight $w_f$, the matrix material has a weight $w_m$ and a weight percentage of the matrix material with respect to $(w_f+w_m)$ is from 5 wt. % to 50 wt. %.

6. The ballistic resistant article according to claim 1, wherein the areal density of the fibers in a single fibrous layer ranges from 10 g/m$^2$ to 250 g/m$^2$.

7. The ballistic resistant article according to claim 1, wherein the total areal density of a single fibrous layer ranges from 11 g/m$^2$ to 350 g/m$^2$.

8. The ballistic resistant article according to claim 1, wherein the plurality of fibrous layers is formed into a panel and the panel is joined to a plate of metal or ceramic.

9. Ballistic resistant article according to claim 1, wherein a scrim comprising a thermoplastic material is situated between the fibrous layers.

10. The ballistic resistant article according to claim 1, wherein the at least one tackifier is homogenously distributed in the matrix material.

11. The ballistic resistant article according to claim 1, wherein the at least one tackifier is present in the matrix material in the weight percentage with respect to the weight of the matrix material ranging from 1 wt. % to 20 wt. % to reduce water pickup in comparison to a ballistic resistant article of the same construction but without the tackifier.

12. The ballistic resistant article according to claim 1, wherein the at least one tackifier is present in the matrix material in the weight percentage with respect to the weight of the matrix material ranging from 1 wt. % to 20 wt. % to reduce delamination of the plurality of fibrous layers upon ballisitic attack in comparison to a ballistic resistant article of the same construction but without the tackifier.

13. A process to manufacture a ballistic resistant article comprising the steps:

(1) Manufacture of a single unidirectional fibrous layer comprising a matrix material, which comprises a mixture comprising at least one self-crosslinking acrylic resin and/or at least one crosslinkable acrylic resin, and at least one tackifier providing the matrix with tack, wherein the at least one tackifier is present in the matrix material in a weight percentage with respect to the weight of the matrix material ranging from 1 wt. % to 20 wt. %, (2) manufacture of an adherent cross-ply from at least two unidirectional single fibrous layers resulting from step (1), (3) manufacture of a consolidated panel from a number of adherent cross-plies resulting from step (2), and optionally (4) joining of the consolidated panel resulting from step (3) to a plate of metal or ceramic to yield a hard-ballistic resistant article.

14. The process according to claim 13, wherein a crosslinking reaction of the at least one self-crosslinking acrylic resin and/or of the at least one crosslinkable acrylic resin is comprised in at least one of the steps (1), (2) and (3).

* * * * *